US005137426A

United States Patent [19]

Rhoda

[11] Patent Number: 5,137,426

[45] Date of Patent: Aug. 11, 1992

[54] BLADE SHROUD DEFORMABLE PROTECTIVE COATING

[75] Inventor: James E. Rhoda, Mason, Ohio

[73] Assignee: General Electric Company, Cincinnati, Ohio

[21] Appl. No.: 563,173

[22] Filed: Aug. 6, 1990

[51] Int. Cl.[5] ..... F01D 5/22

[52] U.S. Cl. ..... 416/191; 416/196 R; 416/241 R

[58] Field of Search ..... 416/190, 191, 193 R, 416/195, 196 R, 224, 241 R

[56] References Cited

U.S. PATENT DOCUMENTS

| | | | |
|---|---|---|---|
| 2,776,253 | 1/1957 | Scholl | 416/241 R |
| 3,041,040 | 6/1962 | Levinstein | 416/241 R |
| 3,327,995 | 6/1967 | Blackhurst et al. . | |
| 3,357,850 | 12/1967 | Baker | 416/241 R |
| 3,451,654 | 6/1969 | Johnson . | |
| 3,572,971 | 3/1971 | Seiwert | 416/241 A |
| 3,576,377 | 4/1971 | Beanland et al. . | |
| 3,694,104 | 9/1972 | Erwin | 416/241 R |
| 3,699,623 | 10/1972 | Kreider | 416/241 R |
| 3,734,646 | 5/1973 | Perkins . | |
| 3,758,233 | 9/1973 | Cross et al. | 416/241 R |
| 3,762,835 | 10/1973 | Carlson et al. | 416/224 |
| 4,108,572 | 8/1978 | Platt | 416/224 |
| 4,257,741 | 3/1981 | Betts et al. . | |
| 4,798,519 | 1/1989 | Zipps et al. . | |

FOREIGN PATENT DOCUMENTS 0951231 3/1964 United Kingdom .

*Primary Examiner*—Edward K. Look
*Assistant Examiner*—James A. Larson
*Attorney, Agent, or Firm*—Jerome C. Squillaro; John R. Rafter

[57] ABSTRACT

A bladed rotor having blades with blade shrouds includes a deformable protective coating applied to the blades to increase the damage tolerance of the blades during foreign object ingestion. The protective coating deforms upon impact between the shroud and airfoil of adjacent blades. The deformation absorbs impact energy and improves distribution of the impact load transferred between the blades.

23 Claims, 5 Drawing Sheets

BLADE SHROUD DEFORMABLE PROTECTIVE COATING

BACKGROUND OF THE INVENTION

1. Field of the Invention

The present invention relates generally to increasing the durability of blades in gas turbine engines. In particular, the invention relates to a deformable protective coating applied to shrouded blades to reduce susceptibility to blade airfoil damage caused by the impact between the shroud and airfoil of adjacent blades. The coating acts as a shock absorber by deforming on impact so that the localized impact energy transmitted to the airfoil is reduced.

2. Description of the Known Art

Gas turbine engines having axial flow fans and compressors frequently use mid span shroud projections to provide damping or reduce blade airfoil vibration. The fan or compressor blades have airfoil sections extending radially from a rotor disk. The shroud projections extend circumferentially from each blade airfoil and contact shroud projections on adjacent blades during engine operation. The adjacent shroud projections have opposing mating faces that are in abutting engagement during engine operation. Together, the shrouds on all the blade airfoils engage during engine operation to form an annular stiffening ring. Mid span shrouds have commonly been used on high aspect ratio fan and compressor blades. High aspect ratio blades are relatively long and narrow, having high span length to chord width ratios. Such blades are especially susceptible to aerodynamic flutter, and typically have low resonant frequencies which may be excited at rotor operating speeds. The stiffening ring formed by the mid span shrouds prevents blade aerodynamic flutter, and increases the resonant frequency of the blades.

Examples of blades with mid span shrouds are shown in U.S. Pat. Nos. 3,734,646 issued to Perkins May 22, 1973, and U.S. Pat. No. 4,257,741 issued to Betts et al Mar. 24, 1981. The Betts patent describes a shrouded blade with a pad applied to shroud mating faces. However, the pad in Betts is wear resistant rather than deformable, and does not address reducing damage to blade airfoils due to impact between the shroud and airfoil of adjacent blades.

During engine operation foreign objects may be ingested by the fan and compressor sections. The fan and compressor blades must be designed to withstand such foreign object ingestion with minimum damage to the blade airfoils. During a severe ingestion event, such as a bird ingestion, the blade struck by the foreign object can be damaged. In addition, the sudden loading on the blade can cause the blade shroud to disengage from the shroud on the adjacent blade and slide forward to impact against the adjacent blade airfoil. The impact of the shroud against the adjacent blade airfoil can result in severe localized impact loads and airfoil damage requiring the adjacent blade to be replaced. In extreme cases, blade failure can occur, requiring engine shutdown due to vibration caused by out of balance loads.

One possible approach to reducing airfoil damage during foreign object ingestion is to thicken the airfoil section. However, thickening the airfoil section is undesirable because it adds weight to the engine and can affect the aerodynamic performance of the blade airfoil. As a result, engineers and scientists continue to seek better methods for increasing the foreign object damage tolerance of blades used in gas turbine engines.

SUMMARY OF THE INVENTION

It is therefore an object of the present invention to provide a means for minimizing airfoil damage from shroud impact during foreign object ingestion.

It is a further object of the present invention to provide a means for minimizing airfoil damage from shroud impact which does not adversely affect blade performance or significantly increase engine weight.

It is a further object of the present invention to provide a means for minimizing airfoil damage which does not add mechanical complexity to the engine.

It is a further object of the present invention to provide a means for minimizing airfoil damage which is easily and inexpensively adaptable to existing engine hardware.

It is a further object of the present invention to provide a means for minimizing airfoil damage which is durable and subject to minimal erosion or service deterioration caused by air flow through the blades.

The objects of the invention will be more fully understood from the drawings and the following description. Briefly, the present invention is a relatively thin, deformable protective coating applied to a localized area on shrouded blades to reduce blade airfoil damage caused by the impact between the shroud and airfoil of adjacent blades. The coating can deform in response to impact between the shroud and airfoil of adjacent blades to reduce the localized impact energy transmitted to the airfoil, and hence reduce airfoil damage. In a preferred embodiment the deformable protective coating includes an aluminum layer applied to a corner face of a titanium alloy shroud.

BRIEF DESCRIPTION OF THE DRAWINGS

While the specification includes a series of claims which particularly point out and distinctly claim the subject matter which the applicant considers to be his invention, a more complete understanding of the invention will be gained from the following detailed description which is given in connection with the accompanying drawings, in which:

DETAILED DESCRIPTION OF THE DRAWINGS

Figure 1:
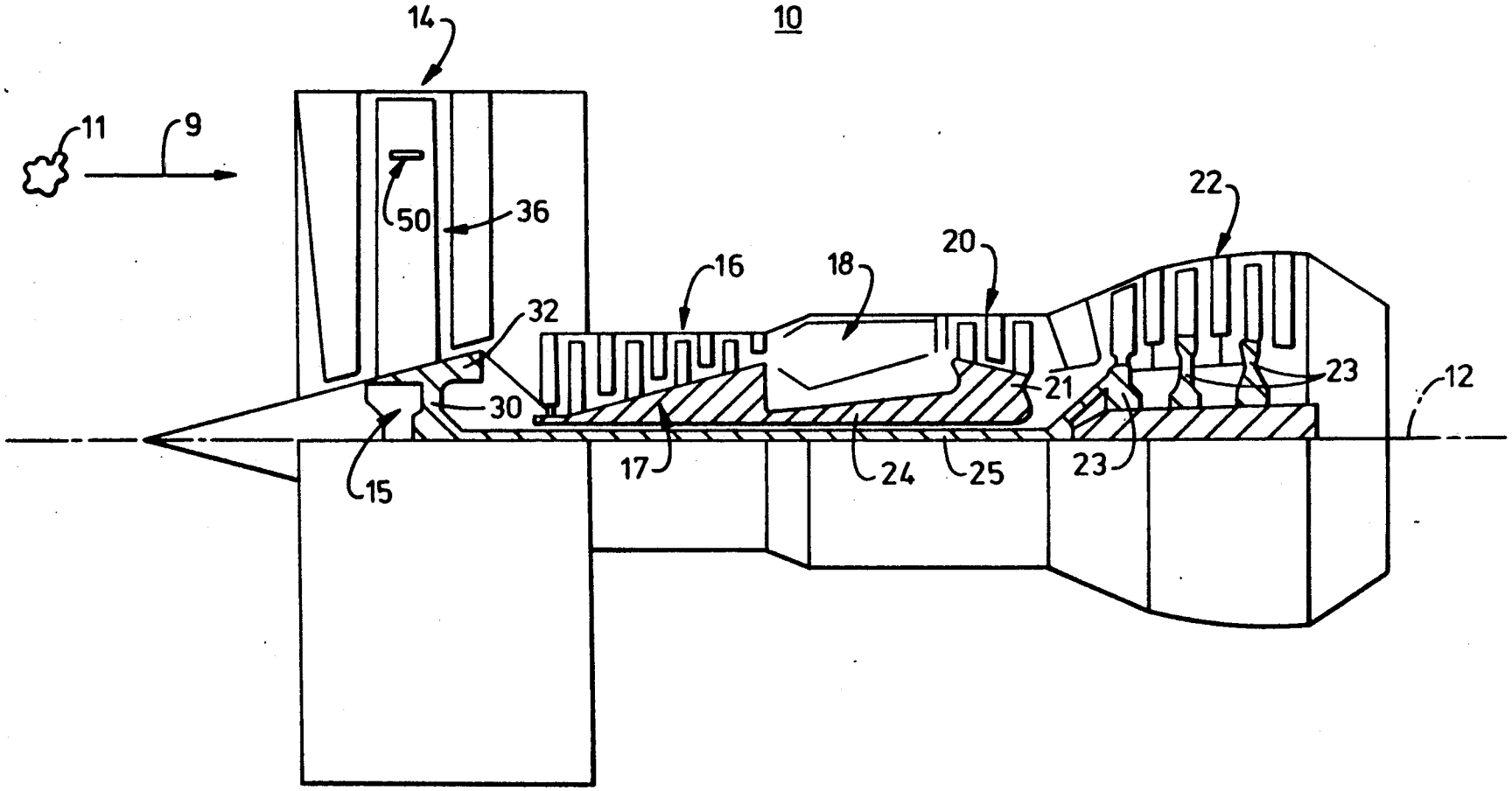
FIG. 1 is a simplified schematic of a gas turbine engine cross section.

FIG. 1 is a simplified schematic of a typical gas turbine engine 10. Engine 10 includes a fan section 14, a compressor section 16, a combustor section 18, a high pressure turbine section 20, and a low pressure turbine section 22, all disposed in a serial relationship in an axial flow path, and generally concentrically arranged about a longitudinal axis 12. During engine operation air, indicated by arrow 9, is pulled into fan section 14 and is compressed by fan bladed rotor 15 and compressor bladed rotor 17 in the fan section 14 and compressor section 16, respectively. Compressed air exiting compressor section 16 flows into combustor section 18 where it is mixed with fuel and burned to produce a high pressure, high temperature gas stream. The high pressure, high temperature gas stream exiting the combustor section 18 is expanded through the high pressure turbine bladed rotor 21 and low pressure bladed rotors 23. The high pressure turbine bladed rotor 21 drives the compressor bladed rotor 17 through a core shaft 24, and the low pressure turbine bladed rotors 23 drive the fan bladed rotor 15 through a fan shaft 25, which is generally coaxial with shaft 24. The airstream 9 entering the engine may include one or more foreign objects 11. For instance, birds or other foreign matter, such as dirt and debris, are sometimes ingested by gas turbine engines.

Figure 2:
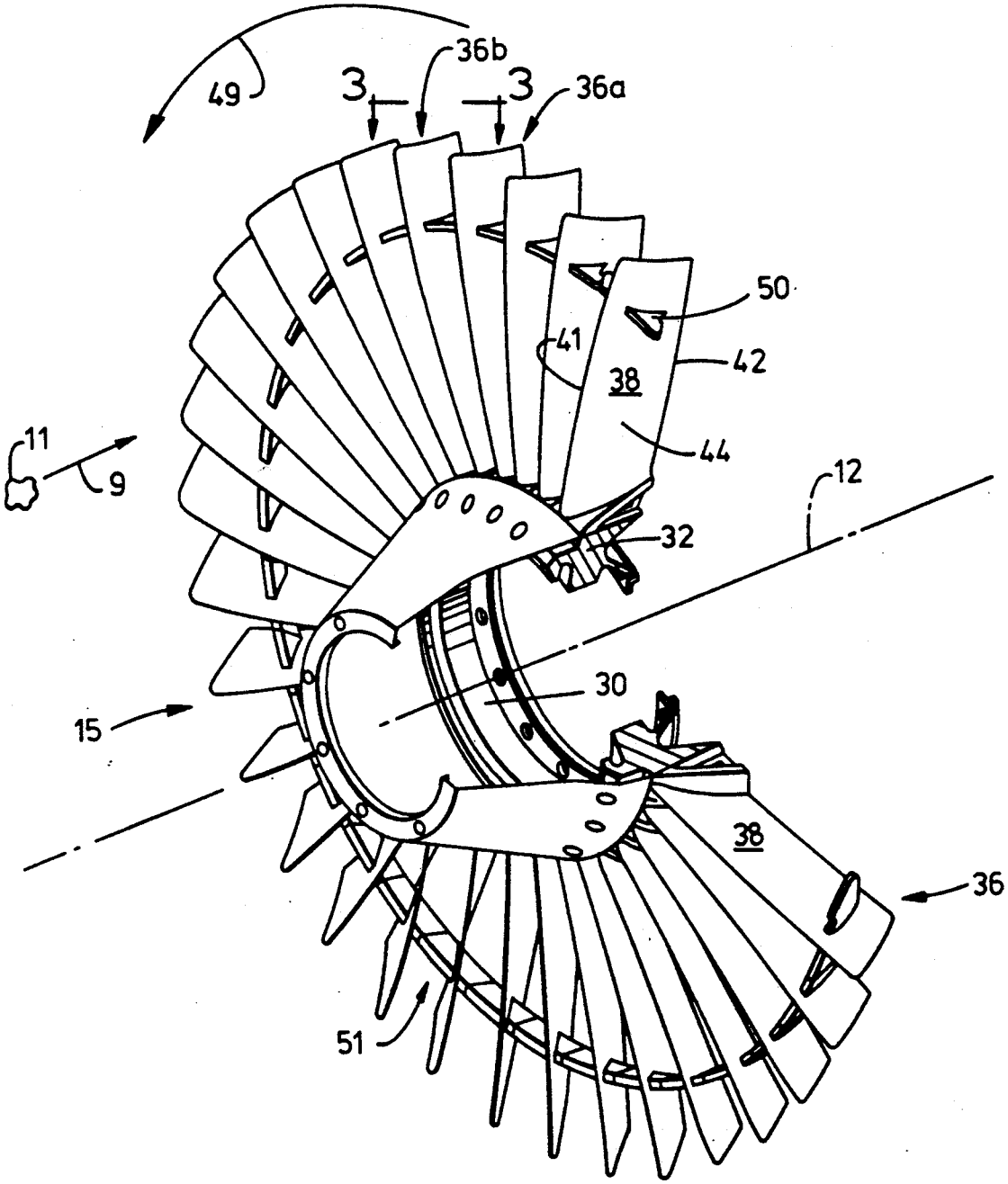
FIG. 2 is an enlarged cutaway view of a bladed rotor in the fan section which includes fan blades with mid span shrouds.

FIG. 2 shows a cutaway view of fan bladed rotor 15. Bladed rotor 15 includes a generally axisymmetric rotor disk 30 and a plurality of blades 36 mounted on a rotor disk rim 32 on the perimeter of rotor disk 30. The blades 36 are mounted on disk rim 32 by means well known to those skilled in the art, such as by fitted engagement with dovetail slots on the disk rim 32. The blades are mounted on the rotor disk rim 32 in a generally uniform, circumferentially spaced apart manner, as shown FIG. 2. Each blade 36 includes an airfoil section 38 extending generally radially outwardly from disk 30. During engine operation, the fan bladed rotor rotates about engine axis 12, as indicated by arrow 49.

Each blade also includes a shroud 50 which extends circumferentially from the blade airfoil, so that the shroud 50 is generally perpendicular to the blade airfoil. Shrouds of adjacent airfoils extend between the adjacent blades. During engine operation the adjacent shrouds are in abutting engagement, and the adjacent shrouds 50, when taken together, form an annular shroud ring 51 which extends circumferentially about, and in spaced relationship to, the rotor disk 30, as shown in FIG. 2.

Figure 3:
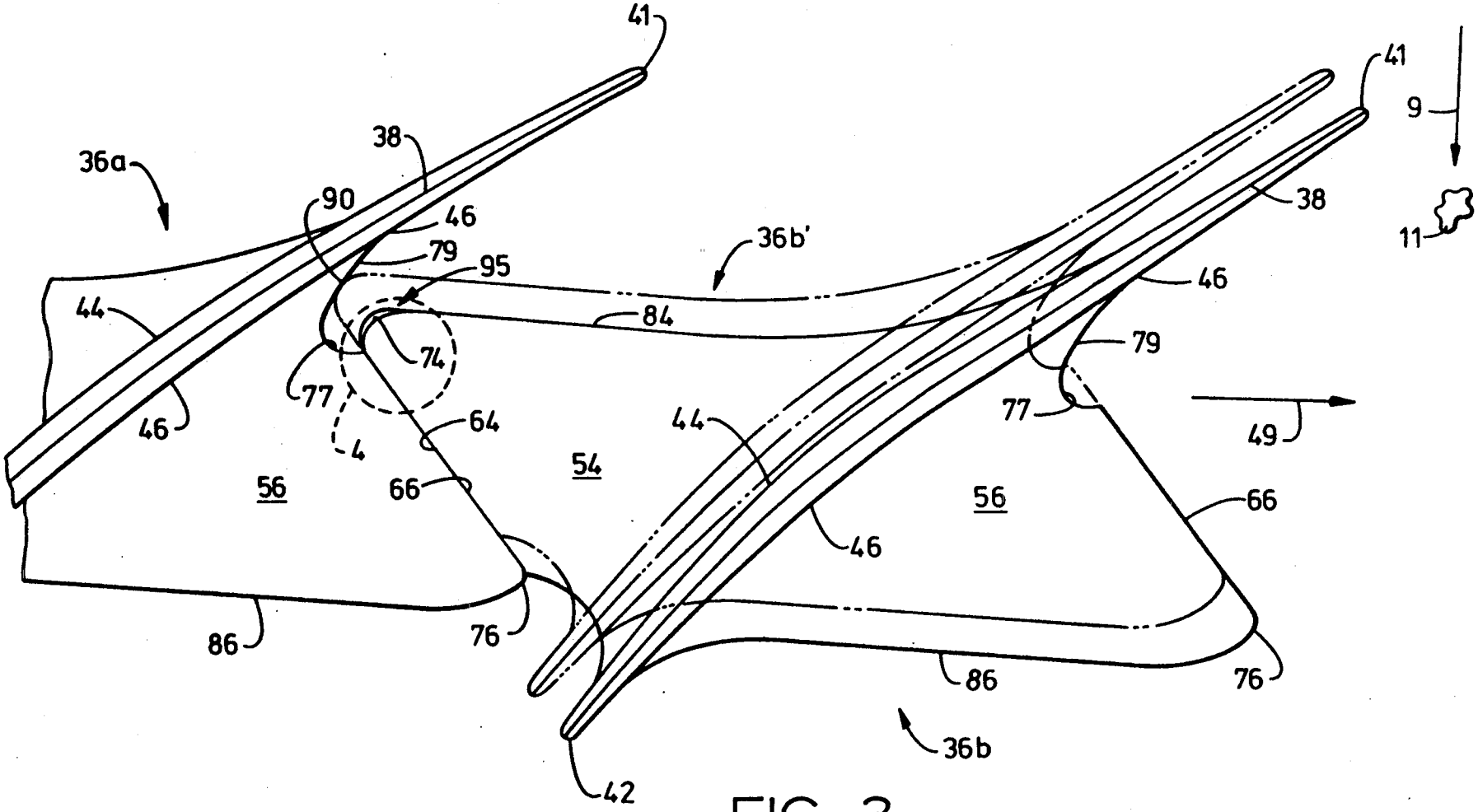
FIG. 3 is a view taken along lines 3—3 in FIG. 2, looking radially inwardly along the blade airfoil axis, and shows the relative motion of adjacent blades due to ingestion of a foreign object.

FIG. 3 is a view taken along lines 3—3 in FIG. 2, looking radially inwardly along the blade airfoil axis of two adjacent blades 36*a* and 36*b*. As shown in FIG. 3, the airfoil section includes a leading edge 41 forming the upstream edge of the airfoil 38 and a trailing edge 42 forming the downstream edge of the airfoil 38. A generally convex suction surface 44 on one side of the airfoil 38 extends from the leading edge 41 to the trailing edge 42. A generally concave pressure surface 46 on the other side of the airfoil 38 extends from the leading edge 41 to the trailing edge 42.

Each blade shroud 50 on each blade 36 can include a first shroud projection 54 extending generally circumferentially from the suction surface 44 of the airfoil and a second shroud projection 56 extending generally circumferentially from the pressure surface 46 of the airfoil. The first shroud projection is generally triangular and includes a first mating face 64, an upstream face 84, and a first corner face 74. First corner face 74 is adjacent first mating face 64 and extends from the first mating face 64 to the upstream face 84. The second shroud projection is generally triangular and includes a second mating face 66, a downstream face 86, and a second corner face 76 extending from the second mating face 66 to the downstream face 86. The second shroud projection 56 also includes a generally concave cutback surface 77 adjacent the second mating surface 66. An airfoil transition surface 79 extends intermediate the cutback surface 77 and the airfoil pressure surface 46. The airfoil transition surface 79 provides a smooth, aerodynamic transition from cutback surface 77 to the pressure surface 46.

Referring again to FIG. 3, during engine operation the first mating face 64 of first shroud projection 54 on each blade is in abutting engagement with the second mating face 66 on the second shroud projection 56 of the adjacent blade. Due to the blade rotation 49, a foreign object 11 entering the engine along airstream 9 may impact against the pressure surface 46 of a blade, such as blade 36*b*. The impact causes disengagement of the first mating face 64 on blade 36*b* from the second mating face 66 on blade 36*a*, and can cause blade 36*b* to slide forward, along the interface between first mating face 64 on blade 36*b* and second mating face 66 on blade 36*a*. The displaced position of blade 36*b* is shown in phantom in FIG. 3, and is indicated as 36*b*'.

The motion of blade 36*b* relative to blade 36*a* results in the corner face 74 of blade 36*b* impacting against the airfoil of blade 36*a*. The impact point on the airfoil transition surface 79 is indicated at point 90 in FIG. 3. The impact of the corner face 74 against blade 36*a* can result in severe airfoil damage on blade 36*a*, and in extreme cases, blade failure.

The invention disclosed in this application provides increased damage tolerance of blade airfoils in the event of foreign object ingestion. The increased damage tolerance is provided by applying a deformable protective coating to each blade. The protective coating is located to reduce airfoil damage caused by impact between the shroud and airfoil of adjacent blades during disengagement of the adjacent blade shrouds. The protective coating deforms during impact, thereby absorbing energy and reducing the impact load transmitted to the airfoil.

Figure 4:
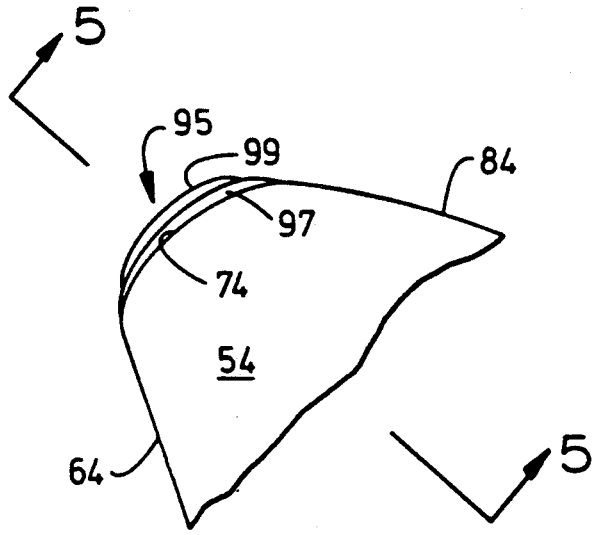
FIG. 4 is a view of enlarged area 4 indicated in FIG. 3, showing the location of the protective coating on the shroud corner face.
Figure 5:
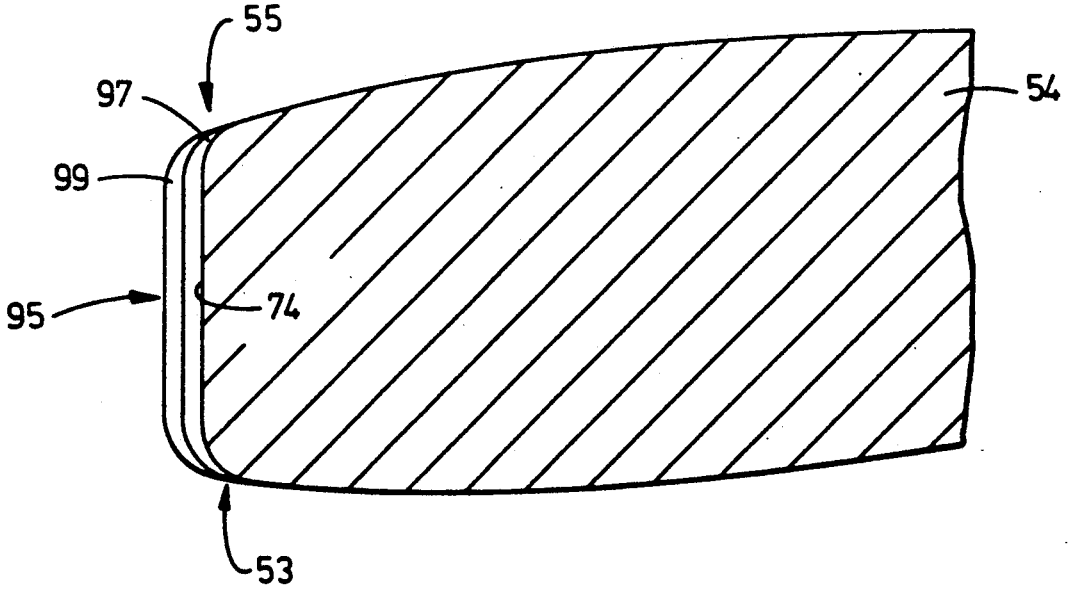
FIG. 5 is a cross sectional view of the protective coating on the corner face of the shroud taken along lines 5—5 in FIG. 4.

Referring to FIG. 3, in the preferred embodiment a protective coating 95 is applied to the first corner face 74 of the first shroud projection 54 extending from each blade airfoil suction surface 44. FIG. 4 shows an enlarged view of the coating 95 on corner face 74. The coating extends over the portion of the corner face 74 which contacts the adjacent blade airfoil during foreign object ingestion. The view in FIG. 5 is taken along lines 5-5 in FIG. 4, and shows the protective coating extending across the thickness of the first shroud projection 54 from a shroud projection bottom edge 53 to a shroud projection top edge 55. In a preferred embodiment, the protective coating is blended smooth with the corner face surface 74, the top edge 53, and bottom edge 55 to eliminate steps or discontinuities which could disrupt airflow over the corner face 74. In a preferred embodiment the protective coating does not extend onto first mating surface 64, nor onto upstream face 84.

Alternatively, the protective coating could be located on the airfoil surface, such as at the impact point 90 in FIG. 3. However, locating the protective coating on the airfoil surface could result in a detrimental effect on the aerodynamic performance of the airfoil, since the airfoil transition surface 79 would include a hump caused by the coating thickness. In addition, the coating would be subject to erosion by the air flow over the airfoil surface. Locating the coating on the shroud corner face does not impose as great an aerodynamic penalty, since the coating can be smoothly blended to the shroud corner face. Locating the coating on the shroud corner face also reduces the coating's susceptibility to erosion by the air flow over the blade airfoils.

In a preferred embodiment the blade 36, including the shroud projections 50 and airfoil 38, is a titanium alloy forging, although the blade may be cast or made from other metals or composites. The titanium alloy blade has a nominal composition by weight of about 6% aluminum, and about 4% vanadium with the balance essentially titanium. This alloy is commonly referred to as Ti-6-4.

The protective coating may include multiple coating layers. Because blade materials such as titanium alloys can form adhesive oxide coatings, it is difficult to obtain good adhesion of some coatings. Thus, it is usually necessary to include a first bond coat layer compatible with the blade material and compatible with a second coat layer. For example, the protective coating 95 can include a first bond coat layer, such as a nickel-aluminum alloy bond coat layer 97, and at least a second coat layer, such as an aluminum outer layer 99 placed over at least a portion of the first bond coat layer, as shown in FIGS. 4 and 5.

The first nickel-aluminum bond coat layer is preferably a 0.004 inch to 0.006 inch thick layer applied to the shroud corner face by, for instance, a conventional plasma spray process to form a plasma sprayed layer on the shroud corner face. The first bond coat layer 97 can have a nominal composition by weight of about 5% aluminum with the balance essentially nickel. A nickel aluminum alloy commercially available as an alloy powder and suitable for plasma spraying is Metco 450 supplied by Metco, Inc.

In a preferred embodiment, the second coat layer is an aluminum outer layer 9 which can be a 0.016 inch to 0.020 inch thick layer applied over at least a portion of first bond coat layer 97 by a conventional plasma spray process to form a plasma sprayed layer on the first bond coat layer 97. In the preferred embodiment, the aluminum outer layer is at least about 99% aluminum by weight, the balance being incidental impurities. A suitable aluminum composition in the preferred embodiment is commercially available as a powder for plasma spraying, such as Metco 54 supplied by Metco, Inc.

Tests to determine the damage tolerance of blades during foreign object ingestion are required for fan blade certification, and are typically conducted by firing projectiles into rotating blades during engine testing. Testing conducted on blades without the protective coating showed that the shroud corner face 74 digs into the airfoil transition surface 79 at point 90 on the adjacent blade, so that the impact energy is concentrated at the impact point 90 in FIG. 3. The tests exhibited airfoil damage exceeding that allowable for certification.

Tests conducted on blades with the protective coating showed that, on impact, the protective coating deforms. The deformation included not only compression of the protective coating but also a shearing action, or smearing of the protective coating, allowing the shroud corner face to slide slightly relative to the airfoil surface on the adjacent blade. As a result, impact energy is absorbed by the deformation of the coating, and the load transferred to the airfoil is distributed over a larger area than the localized impact point 90. Test results showed that the protective coating reduced airfoil damage to a level allowable for certification.

The energy absorbing and load distributing features of the deformable protective coating are due, at least in part, to the low shear yield strength of the protective coating as compared to the shear yield strength of the blade airfoil material. Shear stress typically results from traction forces applied parallel to the surface of an object. The shear yield strength of a material is the level of shear stress at which the material will undergo permanent set, or permanent deformation. The Ti-6-4 blade alloy, from which the airfoil and shroud are formed, has a minimum shear yield strength exceeding 60 ksi (60,000 pounds per square inch). It is preferred that the shear yield strength of the outer aluminum layer applied by plasma spray should not exceed approximately 5 ksi. A plasma spray layer generally includes voids or inclusions which reduce the strength of the layer. In the preferred embodiment the protective coating shear yield strength is less than about ten percent of the airfoil material shear yield strength.

Figure 6:
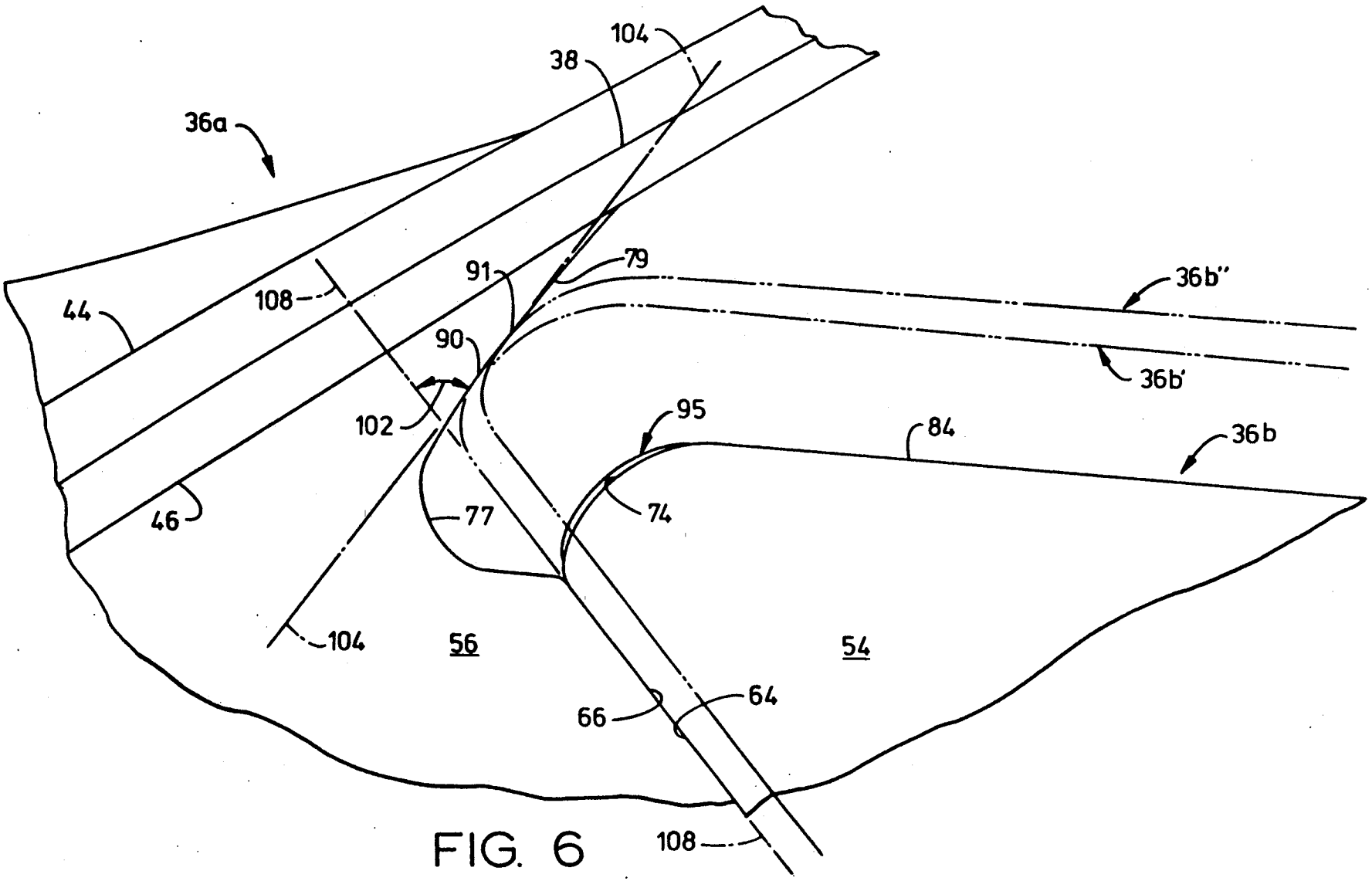
FIG. 6 is an enlarged view of the relative motion of adjacent blades shown in FIG. 3, and also shows the relative sliding of the corner face of the shroud relative to the airfoil on the adjacent blade during deformation of the protective coating.

Referring to FIG. 6, the shroud projection 54 will generally impact against the adjacent airfoil such that the impact force includes a force component perpendicular to the airfoil surface and a force component parallel to the airfoil surface. For instance, the tangent to airfoil transition surface 79 at impact point 90 is indicated by an imaginary axis 104 in FIG. 6. During foreign object ingestion, first shroud projection 54 slides along an imaginary axis 108, which is generally parallel to first mating surface 64 on blade **36*b* and second mating surface 66 on blade 36*a*. Angle 102 formed by the intersection of axis 104 and axis 108 is less than ninety degrees. As a result, the shroud projection 54 impacts at point 90 with a component of force parallel to the airfoil transition surface 79, as well as with a component of force perpendicular to airfoil transition surface 79. On blades without the protective coating, the titanium shroud corner face 74 digs into the titanium airfoil transition surface 79 at point 90**. The high shear yield strength of the airfoil resists deformation and does not permit sliding of the shroud corner face that would otherwise be induced by the force component parallel to the airfoil surface.

In contrast, the low shear yield strength of the protective coating 95 allows the coating to deform by shearing, or smearing, on impact at point 90. Shearing of the protective coating permits the shroud corner face 74 to slide along the airfoil transition surface 79 to a point 91 displaced from impact point 90 due to the impact force component parallel to airfoil transition surface 79. The displaced position of blade **36*b* due to this sliding motion is indicated in phantom as 36*b*″ in FIG. 6. Deformation of the coating absorbs impact energy. In addition, deformation of the coating and the slight sliding of the shroud corner face relative to the airfoil result in distribution of the impact load over a larger area on the airfoil transition surface 79**. Therefore, localized impact stress on the airfoil, which is a measure of force per unit area, is reduced.

While a specific embodiment of the present invention has been described, it will be apparent to those skilled in the art that various modifications can be made without departing from the scope of the invention as recited in the appended claims. For instance, the invention has been described in relation to a shroud protective coating on a fan blade, but the invention is also adaptable to shrouded compressor or turbine blades. Similarly, the invention was described for titanium alloy blades, but other applications could include a shroud protective coating on a blade having a different metal composition, or on a blade having a composite material construction. Further, other applications could include different combinations of shroud coating material and airfoil material, where the shear yield strength of the protective coating is low compared to the shear yield strength of the airfoil material.

The present invention has been described in connection with a specific representative example and embodiment. However, it will be understood by those skilled in the art that the invention is capable of other examples and embodiments without departing from the scope of the appended claims.

I claim:

1. A bladed rotor comprising:

a) a rotor disk;

b) a plurality of blades generally uniformly circumferentially mounted on the rotor disk, each blade including an airfoil extending radially outwardly from the rotor disk and having an airfoil surface formed from a relatively higher strength material, and each blade further including a shroud extending circumferentially from the airfoil, wherein shrouds of adjacent blades are in abutting engagement; and c) a permanently deformable protective coating including a relatively lower strength material externally applied to each blade, wherein the protective coating is located to reduce airfoil damage caused by impact between the shroud and airfoil of adjacent blades.

2. The bladed rotor as recited in claim 1, wherein the deformable protective coating is applied to the shroud.

3. The bladed rotor as recited in claim 1, wherein the deformable protective coating has a shear yield strength less than the shear yield strength of the airfoil material.

4. The bladed rotor as recited in claim 1, wherein the shear yield strength of the airfoil material is at least ten times greater than the shear yield strength of the deformable protective coating.

5. The bladed rotor as recited in claim 1, wherein the deformable protective coating includes an aluminum layer.

6. The bladed rotor as recited in claim 1, wherein the blade, including the shroud and airfoil, is a titanium alloy, and wherein the deformable protective coating includes at least an aluminum coat layer.

7. The bladed rotor as recited in claim 1, wherein the deformable protective coating includes a first bond coat layer compatible with the blade material and applied to at least a portion of the blade, and a second coat layer compatible with the first bond coat layer and applied over at least a portion of the first bond coat layer.

8. The bladed rotor as recited in claim 7, wherein the first bond coat layer is a nickel-aluminum alloy having a nominal composition by weight of about 5% aluminum with the balance essentially nickel.

9. The bladed rotor as recited in claim 8, wherein the second coat layer is at least about 99% aluminum by weight, the balance being incidental impurities.

10. The bladed rotor as recited in claim 9, wherein the first bond coat layer is between approximately 0.004 inch and 0.006 inch thick, and wherein the second coat layer is between approximately 0.016 inch and 0.020 inch thick.

11. The bladed rotor as recited in claim 10, wherein the first bond coat layer and the second coat layer are plasma sprayed layers.

12. The bladed rotor as recited in claim 11, wherein the blade, including the airfoil and shroud, is a titanium alloy forging having a nominal composition by weight of about 6% aluminum and about 4% vanadium with the balance essentially titanium.

13. A blade for mounting on a rotor disk in a substantially uniformly and circumferentially spaced apart relationship with other blades on the rotor disk, the blade comprising:

a) an airfoil section extending radially outwardly from the disk and having an airfoil surface, including a pressure surface and a suction surface, said pressure surface formed from a relatively higher strength material;

b) a first shroud projection extending circumferentially from the suction surface of the blade airfoil section, the first shroud projection including a first mating face and a corner face adjacent the first mating face;

c) a second shroud projection extending circumferentially from the pressure surface of the blade airfoil section, the second shroud projection including a second mating face, wherein the first and second mating faces are adapted for respectively mating second and first faces of adjacent blades on the rotor disk in abutting engagement; and d) a permanently deformable protective coating including a relatively lower strength material applied to the corner face on the first shroud projection, wherein the deformable protective coating is located to reduce airfoil damage caused by impact between the first shroud projection and airfoil of adjacent blades.

14. The blade as recited in claim 13, wherein the deformable protective coating shear yield strength is less than the shear yield strength of the airfoil material.

15. The blade as recited in claim 13, wherein the airfoil material has a shear yield strength at least ten times the shear yield strength of the deformable protective coating.

16. The blade as recited in claim 13 wherein the deformable protective coating includes an aluminum layer.

17. The blade as recited in claim 16, wherein the aluminum layer is a plasma sprayed layer.

18. The blade as recited in claim 13, wherein the protective coating includes a first bond coat layer compatible with the shroud material and applied to at least a portion of the corner face on the first shroud projection, and a second coat layer compatible with the first bond coat layer and applied to at least a portion of the first bond coat layer.

19. The blade as recited in claim 18, wherein the first bond coat layer and the second coat layer are plasma sprayed layers.

20. The blade as recited in claim 18, wherein the first bond coat layer is a nickel-aluminum alloy having a nominal composition by weight of about 5% aluminum with the balance essentially nickel.

21. The blade as recited in claim 20, wherein the second coat layer is at least about 99% aluminum by weight, the balance being incidental impurities.

22. The blade as recited in claim 21, wherein the first bond coat layer is between approximately 0.004 inch and 0.006 inch thick, and wherein the second coat layer is between approximately 0.016 inch and 0.020 inch thick.

23. The blade as recited in claim 22, wherein the blade, including the airfoil and shroud, is a titanium alloy forging having a nominal composition by weight of about 6% aluminum and about 4% vanadium with the balance essentially titanium.

* * * * *